US008162625B1

(12) United States Patent
Soderstrom

(10) Patent No.: US 8,162,625 B1
(45) Date of Patent: Apr. 24, 2012

(54) NESTED MOTOR, REDUCTION MOTOR REDUCTION GEAR AND PUMP WITH SELECTABLE MOUNTING OPTIONS

(76) Inventor: Harry Soderstrom, Marietta, GA (US)

( * ) Notice: Subject to any disclaimer, the term of this patent is extended or adjusted under 35 U.S.C. 154(b) by 336 days.

(21) Appl. No.: 12/564,351

(22) Filed: Sep. 22, 2009

(51) Int. Cl.
*F04B 17/03* (2006.01)
*F01C 1/16* (2006.01)

(52) U.S. Cl. ..... 417/360; 417/410.4; 418/201.1

(58) Field of Classification Search ..... 417/410.4, 417/360; 418/201.1
See application file for complete search history.

(56) References Cited

U.S. PATENT DOCUMENTS 2,152,607 A * 3/1939 Schmitter et al. ..... 184/6.18
2,173,339 A * 9/1939 Myers ..... 74/421 A
2,619,039 A * 11/1952 Maisch ..... 418/206.7
2,880,676 A * 4/1959 Succop ..... 417/410.4
3,576,379 A * 4/1971 Parise ..... 417/410.4
4,588,358 A * 5/1986 Rietschle ..... 417/247
4,767,284 A * 8/1988 Shiinoki et al. ..... 417/312
6,416,302 B1 * 7/2002 Achtelik et al. ..... 418/201.1
6,764,284 B2 * 7/2004 Oehman, Jr. ..... 417/360
6,948,915 B2 * 9/2005 Nishimura ..... 417/297
2005/0232789 A1 * 10/2005 Hinz et al. ..... 417/410.1
2005/0254970 A1 * 11/2005 Mayer et al. ..... 417/410.4

* cited by examiner

*Primary Examiner* — Charles Freay
(74) *Attorney, Agent, or Firm* — Stephen J. Stark; Miller & Martin PLLC

(57) ABSTRACT

A pump, reduction gear, motor combination wherein the reduction gear and pump have nesting shafts internal to at least one of the housings of the pump and reduction gears. The housings meet at cooperating front and rear flanges having a plurality of bores therethrough, and selection from a number of orientations is possible whereby a pump outlet can be selectively oriented at a number of predetermined orientations relative to the reduction gears. The reduction gears also preferably provide a base spaced from the front flange which provides for mounting to a support to thereby suspend the motor cantileveredly from the reduction gears.

20 Claims, 3 Drawing Sheets

NESTED MOTOR, REDUCTION MOTOR REDUCTION GEAR AND PUMP WITH SELECTABLE MOUNTING OPTIONS

FIELD OF THE INVENTION

The present invention relates to positive displacement pumps run by motors driven through reduction gears and more specifically to lobe pumps driven by a drive shaft connected to a set of reduction gears with a nested shaft arrangement and driven by a motor with mounting brackets, preferably integrally connected to the reduction gear housing and providing a selective ability to choose from of a number of configurations to orient an outlet of the pump amongst a plurality of directional alternatives relative to the reduction gears.

BACKGROUND OF THE INVENTION

Motors connected directly to pumps have incorporated nested shafts such as is shown in U.S. Published Patent Application No. 2009/0087230 between a motor 16 and the pump 11. However, this construction lacks a separate reduction gear and does not address a lobe pump. Furthermore, patents such as U.S. Pat. No. 5,290,028 show a nested shaft configuration between a reduction gear having a mounting flange and a "mating machine." Shaft 101 and 201 describes input shafts which nest which would be an exact opposite of a construction contemplated by the applicant which would relate to output shafts. Specifically a "mating machine" in this configuration would be a motor which drives input shafts 101 or 201 opposed to a pump. Additionally, patents such as U.S. Pat. No. 3,398,695 show an ability to rotate a pump relative to a flange provide a plurality of possible orientations for fluid delivery connection 46. However, it is believed to be important to recognize in this style centrifugal pump and the motor are both driven by centrally disposed shafts. Furthermore, no separate reduction gears appear to be provided in these constructions.

Lobe pumps have traditionally been connected to reduction gears with connections external to the pump and reduction gear housings.

While improvements have been made to pumps over the years, there is a need to improve the system of operation of lobe pumps lacking a central drive shaft.

SUMMARY OF THE INVENTION

The present object of the present invention provides an improved lobe pump/reduction gear/motor construction.

It is another object of at least some embodiments of the present invention to provide an improved lobe pump/reduction gear/motor construction having an improved mounting over prior art constructions.

It is another object of at least some embodiments of the present invention to provide improved lobe pump-reduction gear-motor construction having selective capability of selecting the output direction of the lobe pump relative to a fixed position of the reduction gear housing.

Accordingly, in accordance with the presently preferred embodiment of the present invention, a rotary pump is provided with a drive shaft and a lay shaft. The drive shaft is not centrally located relative to an axis of the pump housing. However, a flange is preferably disposed centrally about the drive shaft (i.e., the drive shaft is centrally located internal to the flange). The flange preferably provides a cross section extending completely about the largest perimeter of the pump as well as extending beyond the housing perimeter as viewed from front to back. The flange is preferably connected to a corresponding flange of a set of reduction gears. An output shaft of the reduction gears preferably nests with the drive shaft of the pump. The flanges engage one another.

The nesting arrangement of the shafts and flanges can be provided so that the connection of the reduction gear out put shaft relative to the pump drive shaft is internal to the flanges and/or housings of the reduction gears. Furthermore, a direction of the outlet of the pump can be selected for at least two different and preferably a plurality of different configurations based on the cooperation of the shafts and flanges. Specifically, an outlet which has a predetermined orientation relative to the pump can be oriented relative to the reduction gears at the flange in a selected direction such as up, left, right or down, or depending upon the construction of the nested shaft and/or the flanges. Other configurations may be possible with other embodiments.

The reduction gears may also preferably be provided with a mounting base integral to the housing which may extend integrally from the housing to provide a central location for supporting the pump on one side and a motor on the other. Base is preferably spaced from flange. Finally, motor is preferably connected to the reduction gears in a nested arrangement. Although an electric motor is illustrated, other motors could be utilized in other embodiments such as hydraulic motors, etc.

In a preferred embodiment, the flange system of the pump and reduction gears provide an outer perimeter with a cross-section. The pump, reduction gear, and motor preferably fit within a substantial portion if not all of that cross section of the flange cross section as viewed from front to back. Possible exceptions involve the electrical connections of the motor and/or base of the reduction gears which may extend beyond the cross section of this embodiment. Accordingly, a sleek profile is provided having improved mounting characteristics for predictability. Operators can employ a cylinder of the diameter of the flange and length substantially the length of the pump reduction gear motor combination at a desired location to estimate if the pump-reduction gear-motor combination will fit within a desired spacing at a specific location. This is particularly helpful in any industrial applications where interference of structures could be problematic such as adjacent piping runs, equipment, etc.

Other advantages of the preferred embodiment will likely be evident to those of ordinary skill in the art and with use of the system.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

Figure 1:
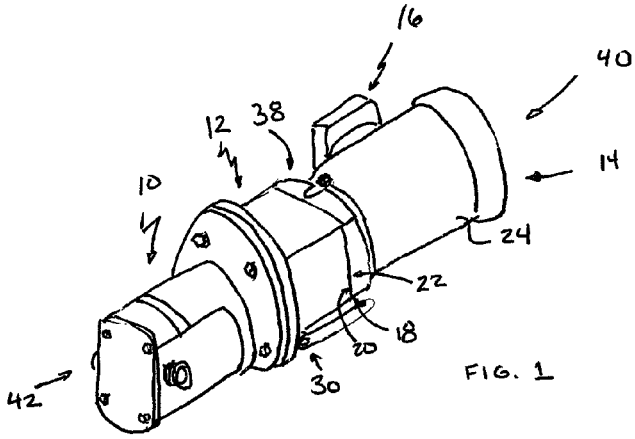
FIG. 1 is a top perspective view of a motor-reduction gear-pump combination of presently preferred embodiment of the present invention.

FIG. 1 shows a presently preferred embodiment of the present invention, namely, a lobe pump 10 is connected to a reduction gear 12 which is connected to a motor 14. Motor 14 may have an electrical connection 16. Other kinds of motors or electric motors can internal electrical connections as are known in the art. Also, hydraulic motors and other motors could be employed in various embodiments.

Reduction gears 12 are provided with a first face illustrated as a motor flange 18 which preferably mounts flush with a end face or rear flange 20 of motor 16 so as to provide the substantially continuous outer perimeter 22 where the reduction gear 12 interfaces with the motor 14. Internal shafts (i.e., output shaft of motor and input shaft of reduction gears) are centrally aligned along axis 44 and may or may not be nested. The front face 22 of the pump 14 preferably defines perimeter 20 which is commiserate in size with the motor housing 24 at the end face 20 as can be seen in reference to FIG. 4 and others.

The front flange 26 of reduction gear 12 preferably has a larger perimeter and cross sectional area than housing 24. In fact, at a cross sectional area and perimeter 28 as viewed from front to back can fit the entire motor 14 except for portions of the electrical housing 16 as can be seen from the pictures. The reduction gears 12 can preferably completely fit within the circumference of perimeter 28 in this trajectory as can be seen from the front view of FIG. 2 except possibly for certain portions of the mounting base 30 from which feet 32,34 extend therefrom.

Feet 32,34 can connect to such structure 35 as is known in the art to facilitate the mounting of reduction gears 12 to a non-moving structure so that the pump can be appropriately located at a desired pumping configuration in an industrial environment such as food processing, etc. Such a configuration has been found particularly desirable for some embodiments, for instance, when attempting to correlate a desired location of the pump-motor-reduction gear combination, a cylinder having the circumference of the flanges 26, 36 and a length at least approximately L can be evaluated to determine whether or not the combination should fit in the desired space. Length L is a length from the pump inlet and outlet 88,90 to the end of motor 14.

Many motors have mounting flanges for connecting motors to support structure. However, the applicant is unaware of any base such as base 30 connected to a set of reduction gears 12 particularly integrally connected to the housing 50, particularly when mated with a motor 14 on one side and a pump 10 on the other. When utilizing this construction of one preferred embodiment a number of advantages can be experienced. First of all, since motor 14 is cantileveredly supported by reduction gear 12, maintenance is particularly simple in that the motor 14 can be removed from the reduction gear 12 in a relatively easy manner as would be understood by one of ordinary skill in the art. Motor 14 is connected from the rear side 38 such as with connectors (not shown) passing through front face 20 into reduction gears 12 or connector 39 extending through to housing 24. Those connectors such as 39 and/or others can be removed and the motor 14 and removed relative to the reduction gears 12 for maintenance and/or replacement in an easy manner while the pump 10 and/or reduction gears 12 are maintained in position. This cannot happen in other constructions of the prior art where the motor is the structurally securely connected to support structure and also likely supporting much of the weight loading of the pump 10. Base 30 is located closer to motor 14 than flange 26 and is spaced apart from flange 26.

Figure 2:
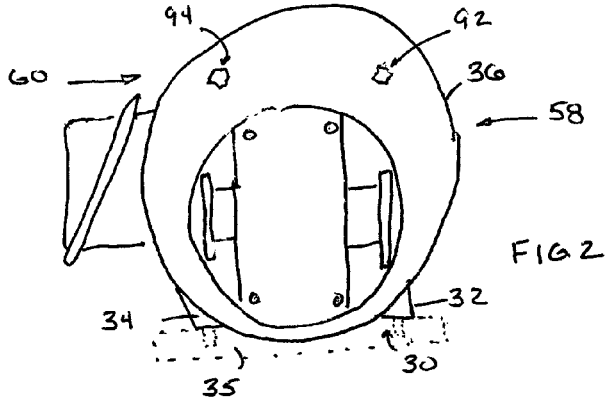
FIG. 2 is a front plan view of the combination shown in FIG. 1.
Figure 3:
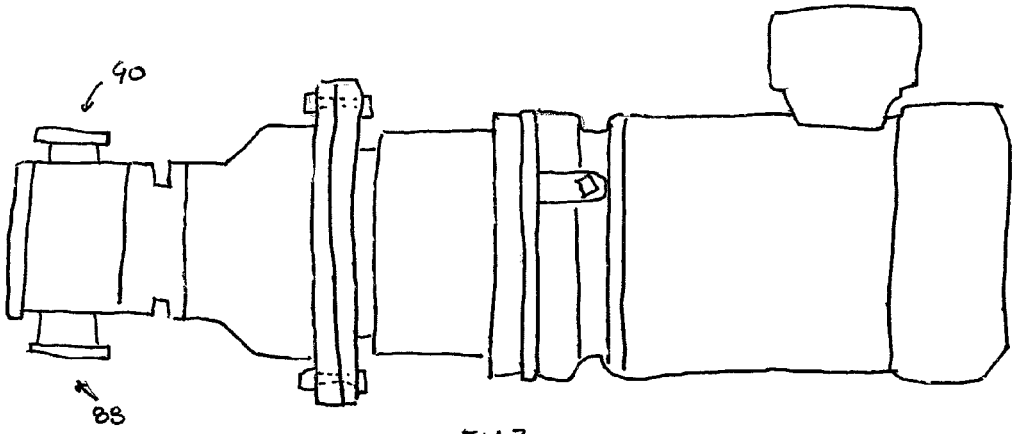
FIG. 3 is a top view of the combination shown in FIG. 1.

As discussed above, the motor 14 can be any kind of motor whether it be an electric, hydraulic or other type of motors known in the art. As shown in FIG. 2, motor 14 may be selected to fit within the cross section and defined by the flanges 26,36 as looking from the front 32 to back 40.

Figure 4:
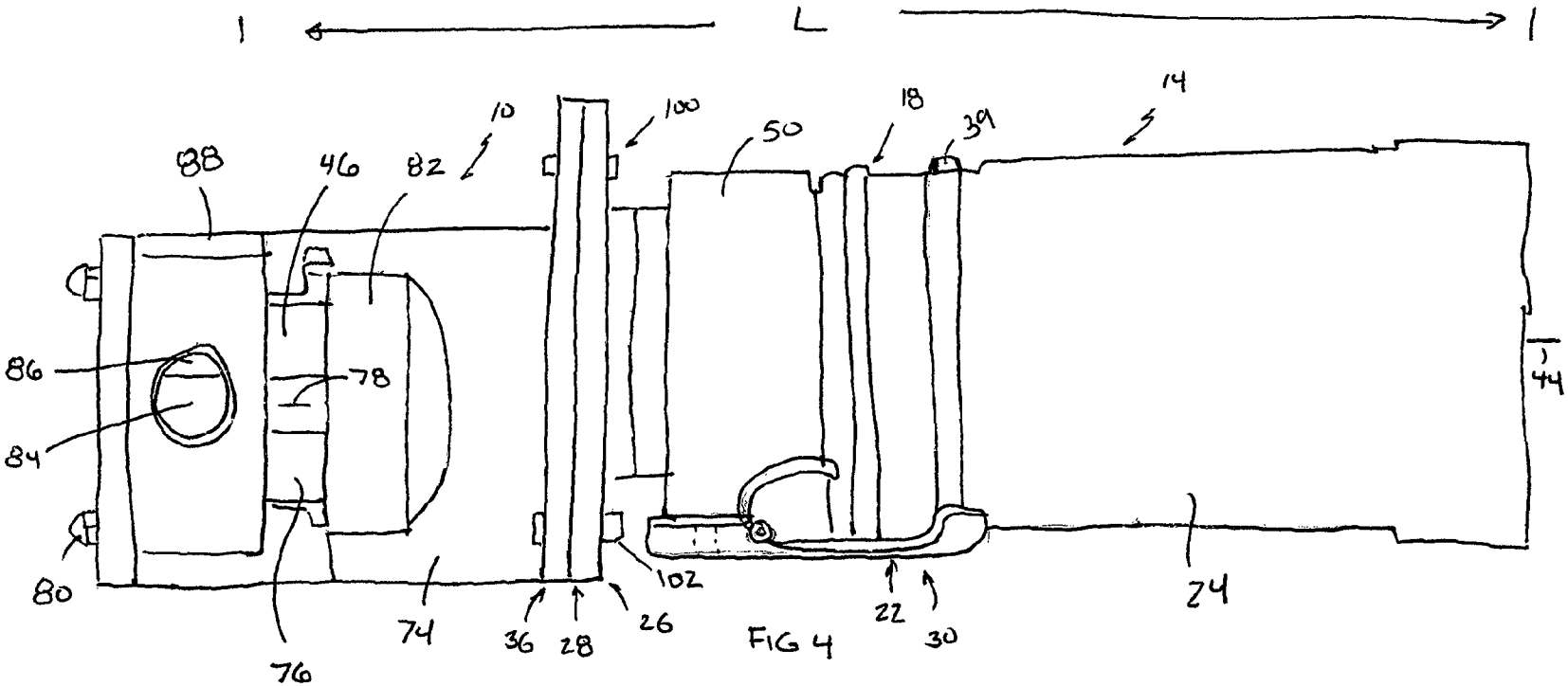
FIG. 4 is a right plan view of the combination shown in FIG. 1.
Figure 5:
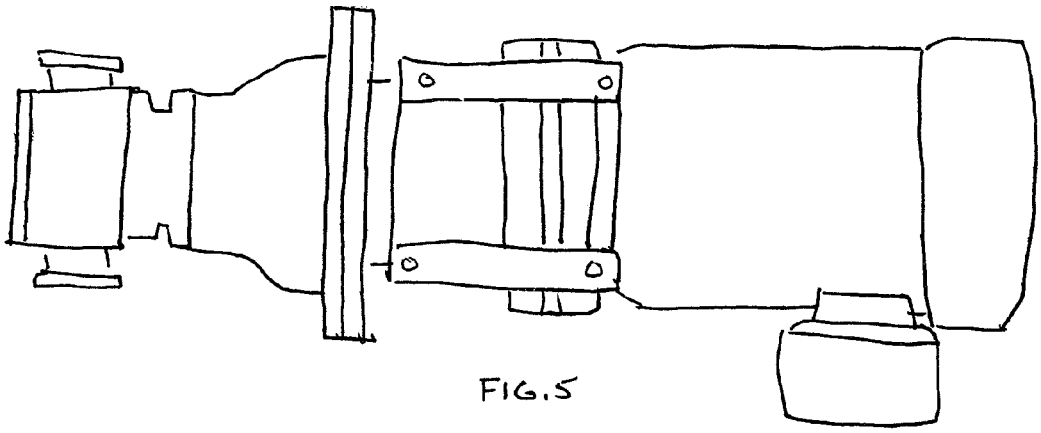
FIG. 5 is a bottom plan view of the combination shown in FIG. 1.

The motor in FIG. 4 has a central shaft along axis 44 which drives an input shaft of the reduction gears 12. Those two shafts could nest internal to one of flanges 22,18, housing 50 or motor housing 24. By nesting it will be understood by one of ordinary skill in the art that a portion of the shaft of the motor 14 and/or housings 24,50 will be located about or internal to a portion of the shaft of the reduction gears 12 so that the housings 24,50 and/or flanges 26,36 cover the shafts.

Figure 6:
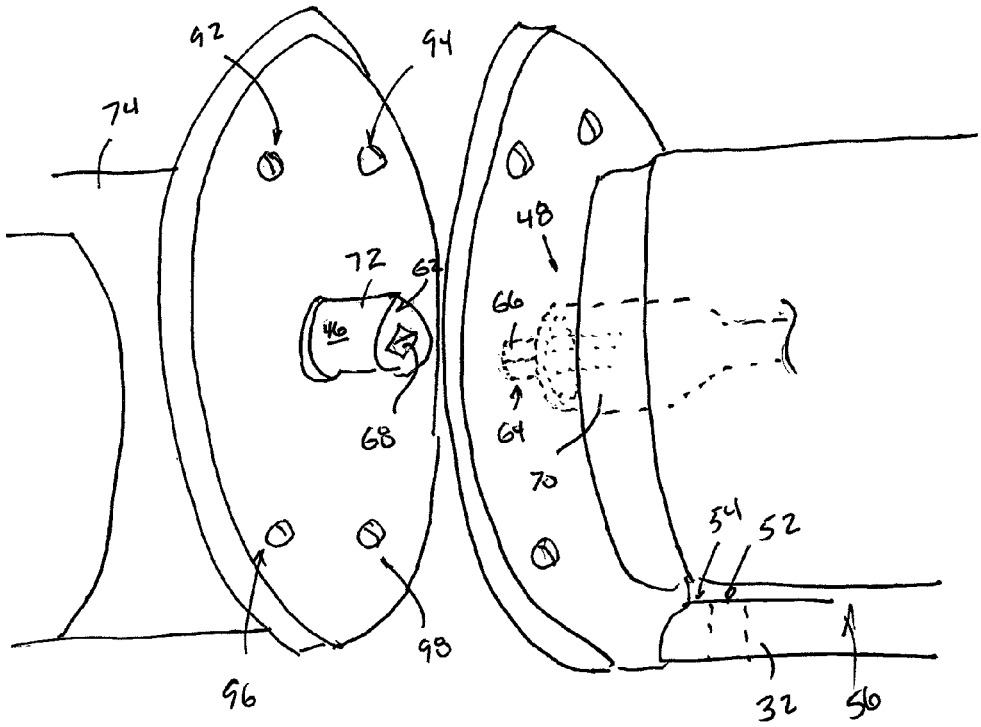
FIG. 6 is a side perspective view of the pump removed from the reduction gear of FIG. 1 showing the nesting arrangement of the shafts with at least a portion illustrated in phantom.

The reduction gears 12 are utilized to change the speed of the motor 14 to affect the speed of the drive shaft 46 of the pump 10 shown in FIG. 6 to which they are operating coupled. Specifically, the input to the reduction gears 12 is provided from the motor 14. The speed of the output shaft 48 is changed by changing the speed of the motor so that the speed of the output shaft 48 is directly related to the speed of the input shaft (not shown) but different. Output shaft 48 rotates at a higher speed than input shaft.

As one of ordinary skill in the art can see from reference to the figures, the output shaft 48 of the reduction gears 14 is centrally located relative to the housing 50 of the reduction gear 12 of the presently preferred embodiment. Accordingly, the output shaft 48 is centrally located relative to the face 18 as well as the flange 26. The housing 50 of the reduction gear, like the housing 24 of the motor is preferably at least substantially contained within the cross sectional area of the flanges 26,36 when looking from the front view in FIG. 2 or from front 42 to back 40. The portions of the base 30 extending from that cross sectional are feet 32,34 (see FIG. 1) which provide bores 52 to allow connectors to extend therethrough to support structure 35 for supporting pump 10, reduction gear 12, motor 14 combination. Motor 14 is preferably supported cantileveredly relative to reduction gear 12.

As can be seen from FIG. 6, upper surface 54 of the foot 32 may be located above the lower surface 56 of the housing 50. The feet 32,34 preferably do not extend past left side 58 or right side 60 of the flanges 26,36 in the preferred embodiment. This compact structure has been found to be an advantage from many embodiments.

As it relates to the pump 10, the pump 10 is shown in FIG. 2 fitting completely within the cross sectional area of the flange 36 as viewed from the front 42 to the rear 40. This too has many advantages in construction and installation as previously discussed.

As can be seen in reference to FIG. 6, the output shaft 48 of the reduction gears is received partially internal to bore 62 of drive shaft 46 of the pump 10, namely, internal shaft 64 which preferably has a plurality of surfaces 66 such as flats which cooperate with internal flats 68 internal to the drive shaft 46 so that when the shafts 46,48 are connected one is internal to the other. Outer shaft portion 70 may go over exterior surface 72 of drive shaft 46. Once again, there may be mating surfaces on the outer surface 72 as well as interior surface 70 as would be understood by those of ordinary skill in the art.

Of course, in other embodiments, only one of the inner and outer shafts 64,70 may be provided. Furthermore, in the other embodiments, an inner and outer shaft may be associated with the drive shaft 46 instead of output shaft 48 in various other embodiments. Furthermore, although the output shaft 48 is shown disposed centrally located relative to housing 50, the same cannot be true relative to the drive shaft 46 relative to pump housing 74. In fact, drive shaft 46 is illustrated not centrally located, but is below central axis 78 as drive shaft and lay shaft 46,76 are preferably symmetrically located relative to the view of FIG. 4 relative to housing 74 or at least a central axis 78 proceeding through the housing 74. In fact, drive shaft 46 does not intersect central axis 78 and is non collinear therewith of pump housing 10. Furthermore, pump housing 10 typically is usually not circularly configured. In particular, it has flats 80,82 are illustrated although it could be round in various other embodiments or other portions.

Lobe pumps such as those illustrated in the preferred embodiment have a drive shaft 46 and a lay shaft 76. The drive shaft 46 is geared to the lay shaft 76 in the housing 74. Both shafts 46,76 are turned at the same speed and thus provides motion for rotors 84,86 as shown in the inlet 88 such as would be true as could be seen in outlet 90. Of course, the inlet and outlet 88,90 are typically interchangeable for most lobe pump constructions.

In addition to having nested shafts 46,48, the flange to flange 26,36 construction to eliminate external connections of the shafts 46,48 relative to the housings 50,74. The applicant's preferred embodiment also provides at least a plurality of bores such as bores 92,94,96 and 98 through which fasteners 100,102 shown in FIG. 4 are directed to connect these flanges 26,36 together. It should be noted that by providing equally spaced bores 92,94,96,98, which are radially disposed relative to the drive shaft 46 and output shaft 48 with appropriate configurations, the pump 10 can be installed relative to the reduction gear 12 at a plurality of positions. Specifically, if there are four flats 66 which cooperate with four cooperating flats 62 in one of the drive shafts 46,48 which are appropriately oriented relative to the bores 92,94,96,98, then not only can the pump 10 have the orientation illustrated in the figure, but it can be turned 90°, 180°, or 270° to achieve one of four configurations therefore directing the inlet 88 into outlet 90 in the appropriate direction as desired for a particular application. While other pumps have the capability of being directed in different orientations for inlets 88 and outlets 90 based on a connection to a motor system shown in U.S. Pat. No. 3,398,695, such pumps require a central pumping axis which cooperates with a central pumping axis of the motor. Also, no reduction gears are contemplated by such a construction. The outer and inner shaft construction 64,70 is also not shown in such a prior art construction as it relates to one of the drive shaft 46 and the output shaft 48 of the reduction gears. Finally, instead of connecting the pump-motor combination support structure at the flange as is illustrated in the U.S. Pat. No. No. 3,398,698, connection from a base 30 spaced from the face 28 is believed to provide desirable stability for the structure as applicant has provided at least for some embodiments.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

The invention claimed is:

1. A lobe pump, reduction gears, motor combination comprising:

a lobe pump having a pump housing, inlet, outlet, and a drive shaft and a lay shaft at least partially surrounded by the pump housing, said pump housing having a rear flange and an axis relative to a center of the housing extending parallel to the drive and lay shafts, said axis is non-colinear with either of the drive and lay shafts;

reduction gears having an output shaft operably coupled to the drive shaft of the lobe pump at the output shaft, said reduction gears also having an input shaft and a housing surrounding at least a portion of the output shaft and the input shaft, said gear housing having a front flange connected to the rear flange of the lobe pump with the output shaft of the reduction gears nested relative to the drive shaft of the pump internal to at least one of the front flange, rear flange, gear housing and the pump housing; and a motor connected by a driven shaft to the input shaft of the reduction gears; wherein the driven shaft of the motor is rotated at a higher speed than the output shaft of the reduction gears; and wherein the front and rear flanges selectively connect together in one of a first and a second of at least two configurations, with the outlet of the pump positioned ninety degrees apart between the first and second configurations.

2. The lobe pump, reduction gears, motor combination of claim 1 further comprising a support and a base connected to the gear housing of the reduction gears, said base connected to the support thereby supporting the motor cantileveredly relatively to the reduction gears with the base spaced apart from the front flange towards the motor.

3. The lobe pump, reduction gears, motor combination of claim 2 wherein the base is integrally connected to the housing.

4. The lobe pump, reduction gears, motor combination of claim 2 wherein the base is integrally connected to the gear housing.

5. The lobe pump, reduction gears, motor combination of claim 1 wherein the front and rear flanges have a plurality of bores, and said drive shaft and said output shaft operably couple at least two angular positions relative to one another with the bores of the front and rear flanges aligning at the at least two angular positions thereby orienting the outlet of the pump in at least two different directions.

6. The lobe pump, reduction gears, motor combination of claim 5 wherein the front and rear flanges have at least four bores respectively and the outlet of the pump may be selected for operation in one of four directions ninety degrees apart from one another.

7. The lobe pump, reduction gears, motor combination of claim 5 further comprising at least two flats on the drive shaft contacting two flats of the output shaft and a portion of a first of the drive shaft and output shaft extending radially over a portion of a second of the drive shaft and output shaft.

8. The lobe pump, reduction gears, motor combination of claim 7 wherein the first of the drive shaft and output shaft has an inner shaft and an outer shaft and the second of the drive shaft and output shaft is received between the inner and outer shafts.

9. The lobe pump, reduction gears, motor combination of claim 1 wherein the drive shaft does not intersect the axis.

10. A lobe pump, reduction gears, motor combination of claim 1 wherein the front and rear flanges meet at a perimeter and the perimeter has a cross section as viewed along the axis whereby the cross section of the perimeter surrounds a largest cross section of the pump.

11. The lobe pump, reduction gears, motor combination of claim 10 wherein the perimeter surrounds a cross section of the gear housing which does not include the base therewith.

12. The lobe pump, reduction gears, motor combination of claim 10 wherein the perimeter surrounds a cross section of a substantial portion of the motor.

13. The lobe pump, reduction gears, motor combination of claim 10 wherein a cylinder having a diameter of the perimeter and a length corresponding to a length substantially the length of the lobe pump, reduction gears and motor combination fits at a desired location without interference before installing the lobe pump, reduction gears, motor combination with the base connected to the support structure.

14. The lobe pump, reduction gears, motor combination of claim 1 wherein the front and rear flanges have a plurality of bores, and said drive shaft and said output shaft operably couple at least two angular positions relative to one another with the bores of the front and rear flanges aligning at the at least two angular positions thereby orienting the outlet of the pump in at least two different directions ninety degrees apart.

15. A lobe pump, reduction gears, motor combination comprising:

a lobe pump having a pump housing, inlet, outlet, and a drive shaft and a lay shaft at least partially surrounded by the pump housing, said pump housing having a rear flange and an axis relative to a center of the housing extending parallel to the drive and lay shafts, said axis is non-colinear with either of the drive and lay shafts;

reduction gears having an input and output shafts and are operably coupled to the drive shaft of the lobe pump at the output shaft, said reduction gears also having a gear housing surrounding at least a portion of the output shaft and the input shaft, said gear housing having a front flange connected to the rear flange of the lobe pump with the output shaft of the reduction gears nested relative to the drive shaft of the pump internal to at least one of the front flange, rear flange, gear housing and the pump housing, and said gear housing having a base;

a motor connected by a driven shaft to the input shaft of the reduction gears; wherein the driven shaft is rotated at a higher speed than the output shaft of the reduction gears; and wherein the base is spaced from the front flange towards the motor; and the front and rear flanges are selectively connected together at one of a first and second of at least two configurations, whereby the outlet of the pump is positioned ninety degrees apart between the first and second configurations.

16. The lobe pump, reduction gears, motor combination of claim 15 wherein the base is integral to the gear housing.

17. The lobe pump, reduction gears, motor combination of claim 15 further comprising a support and wherein the base is connected to the support thereby supporting the motor cantileveredly relative to the reduction gears.

18. The lobe pump, reduction gears, motor combination of claim 15 wherein the front and rear flanges have a plurality of bores, and said drive shaft and said output shaft operably couple at least two angular positions relative to one another with the bores of the front and rear flanges aligning at the at least two angular positions thereby orienting the outlet of the pump in at least two different directions 90 degrees apart.

19. The lobe pump, reduction gears, motor combination of claim 15 wherein the first of the drive shaft and output shaft has an inner shaft and an outer shaft and the second of the drive shaft and output shaft is received between the inner and outer shafts.

20. The lobe pump, reduction gears, motor combination of claim 15 wherein the front and rear flanges meet at a perimeter and the perimeter has a cross section as viewed along the axis whereby the cross section of the perimeter surrounds a largest cross section of the pump.

* * * * *